US007225623B2

(12) United States Patent
Koshoffer

(10) Patent No.: US 7,225,623 B2
(45) Date of Patent: Jun. 5, 2007

(54) TRAPPED VORTEX CAVITY AFTERBURNER

(75) Inventor: John Michael Koshoffer, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 387 days.

(21) Appl. No.: 11/209,918

(22) Filed: Aug. 23, 2005

(65) Prior Publication Data

US 2007/0044476 A1 Mar. 1, 2007

(51) Int. Cl.
*F02K 3/10* (2006.01)
*F23R 3/18* (2006.01)

(52) U.S. Cl. ..... 60/776; 60/766

(58) Field of Classification Search ..... 60/776, 60/761, 765, 766
See application file for complete search history.

(56) References Cited

U.S. PATENT DOCUMENTS 5,791,148 A 8/1998 Burrus
5,857,339 A 1/1999 Roquemore et al.
6,286,298 B1 9/2001 Burrus et al.
6,481,209 B1 11/2002 Johnson et al.
6,735,949 B1 5/2004 Haynes et al.
6,983,601 B2 * 1/2006 Koshoffer ..... 60/761

OTHER PUBLICATIONS

AIAA 95-0810, "Performance of a Trapped-Vortex Combustor", 33rd Aerospace Sciences Meeting and Exhibit, Jan. 9-12, 1995 / Reno, NV, 15 pages.

* cited by examiner

*Primary Examiner*—Ehud Gartenberg
(74) *Attorney, Agent, or Firm*—William Scott Andes; Steven J. Rosen

(57) ABSTRACT

A trapped vortex cavity afterburner includes one or more trapped vortex cavity stages for injecting a fuel/air mixture into a combustion zone. The trapped vortex cavity afterburner is operable to provide all thrust augmenting fuel used for engine thrust augmentation. Each stage has at least one annular trapped vortex cavity. The trapped vortex cavity afterburner may be a multi-stage afterburner having two or more trapped vortex cavity stages ganged for simultaneous ignition or operable for sequential ignition. One embodiment of the annular trapped vortex cavity is operable to raise a temperature of an exhaust gas flow through the afterburner about 100 to 200 degrees Fahrenheit. Each of the trapped vortex cavity stages may be operable to produce a single or a different amount of temperature rise of the exhaust gas flow through the afterburner. A chevron shaped trapped vortex cavity and having zig-zag shaped leading and trailing edges may be used.

26 Claims, 5 Drawing Sheets

TRAPPED VORTEX CAVITY AFTERBURNER

BACKGROUND OF THE INVENTION

The present invention relates generally to aircraft gas turbine engines with thrust augmenting afterburners and, more specifically, afterburners and trapped vortex cavities.

High performance military aircraft typically include a turbofan gas turbine engine having an afterburner or augmentor for providing additional thrust when desired particularly for supersonic flight. The turbofan engine includes in downstream serial flow communication, a multistage fan, a multistage compressor, a combustor, a high pressure turbine powering the compressor, and a low pressure turbine powering the fan. A bypass duct surrounds and allows a portion of the fan air to bypass the multistage compressor, combustor, high pressure, and low pressure turbine.

During operation, air is compressed in turn through the fan and compressor and mixed with fuel in the combustor and ignited for generating hot combustion gases which flow downstream through the turbine stages which extract energy therefrom. The hot core gases are then discharged into an exhaust section of the engine which includes an afterburner from which they are discharged from the engine through a variable area exhaust nozzle.

Afterburners are located in exhaust sections of engines which includes an exhaust casing and an exhaust liner circumscribing a combustion zone. Fuel injectors (such as spraybars) and flameholders are mounted between the turbines and the exhaust liner for injecting additional fuel when desired during reheat operation for burning in the afterburner for producing additional thrust. Thrust augmentation or reheat using such fuel injection is referred to as wet operation while operating dry refers to not using the thrust augmentation. The annular bypass duct extends from the fan to the afterburner for bypassing a portion of the fan air around the core engine to the afterburner. This bypass air is mixed with the core gases and fuel from the spraybars prior and ignited and combusted prior to discharge through the exhaust nozzle. The bypass air is also used in part for cooling the exhaust liner.

Various types of flameholders are known and provide local low velocity recirculation and stagnation regions therebehind, in regions of otherwise high velocity core gases, for sustaining and stabilizing combustion during reheat operation. Since the core gases are the product of combustion in the core engine, they are initially hot, and are further heated when burned with the bypass air and additional fuel during reheat operation. Augmentors currently are used to maximize thrust increases and tend to be full stream and consume all available oxygen in the combustion process yielding high augmentation ratios for example about 70%.

Augmentors are generally heavy, include many parts such as the flameholders and fuel injectors, and are inefficient if used as a partial reheat situation such in engines that operate at subsonic flight speeds only even when operating wet. The flameholders and spraybars extend into the nozzle's flowpath thus causing a loss of performance particularly during dry operation of the engine.

It is, therefore, highly desirable to have an afterburner which does not use spraybars and flameholders and operates efficiently if used as a partial reheater. It is also highly desirable to have an afterburner which has better performance characteristics than previous augmentors.

BRIEF DESCRIPTION OF THE INVENTION

A turbofan gas turbine engine afterburner includes one or more trapped vortex cavity stages for injecting a fuel/air mixture into a combustion zone and is operable to provide all thrust augmenting fuel used for engine thrust augmentation. Each trapped vortex cavity stage has at least one annular trapped vortex cavity. The trapped vortex cavity afterburner may be a multi-stage afterburner having two or more trapped vortex cavity stages operably ganged for simultaneous ignition or operable for sequential ignition. One embodiment of the annular trapped vortex cavity is operable to raise a temperature of an exhaust gas flow through the afterburner about 100 to 200 degrees Fahrenheit. Each of the trapped vortex cavity stages may be operable to produce a single or a different amount of temperature rise in the exhaust gas flow flowing through the afterburner. The trapped vortex cavity may be chevron shaped and have zig-zag shaped leading and trailing edges.

The trapped vortex cavity afterburner may be incorporated in a turbofan gas turbine engine having a fan section upstream of a core engine, an exhaust combustion zone downstream of the core engine, and an annular bypass duct circumscribing the core engine. The trapped vortex cavity afterburner and its one or more trapped vortex cavity stages are operably positioned for injecting a fuel/air mixture into the combustion zone. The trapped vortex cavity afterburner is operable to provide all thrust augmenting fuel used for engine thrust augmentation.

BRIEF DESCRIPTION OF THE DRAWINGS

The foregoing aspects and other features of the invention are explained in the following description, taken in connection with the accompanying drawings where.

DETAILED DESCRIPTION OF THE INVENTION

Figure 1:
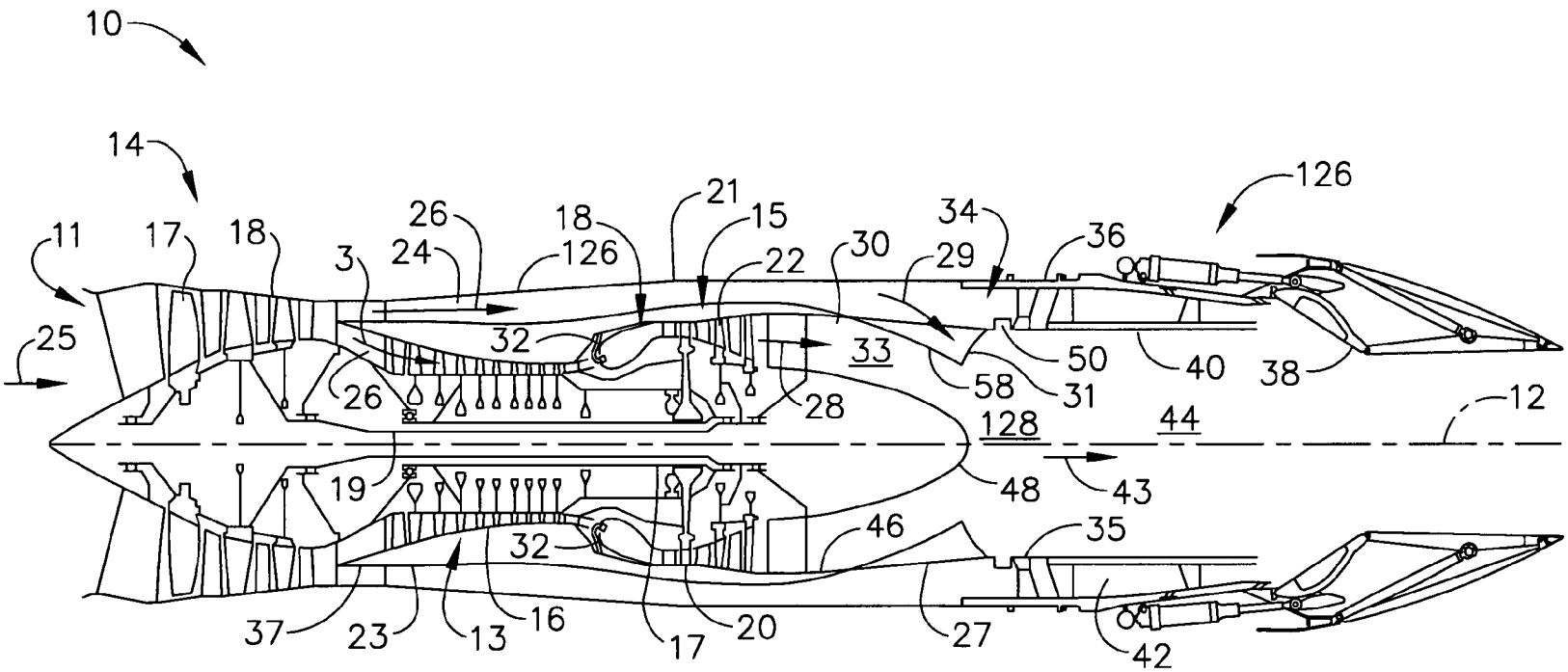
FIG. 1 is an axial sectional view through an exemplary turbofan gas turbine engine having a trapped vortex cavity afterburner.

Illustrated in FIG. 1 is an exemplary medium bypass ratio turbofan gas turbine engine 10 for powering an aircraft (not shown) in flight having only one afterburner which is a trapped vortex cavity afterburner 34 located in an exhaust section 126 of the engine. The engine 10 is axisymmetrical about a longitudinal or axial centerline axis 12 and has a fan section 14 upstream of a core engine 13. The core engine 13 includes, in serial downstream flow communication, a multistage axial high pressure compressor 16, an annular combustor 18, and a turbine section 15. The turbine section 15 illustrated herein includes a high pressure turbine 20 suitably joined to the high pressure compressor 16 by a high pressure drive shaft 17. Downstream of the turbine section 15 and the core engine 13 is a multistage low pressure turbine 22 suitably joined to the fan section 14 by a low pressure drive shaft 19. The core engine 13 is contained within a core engine casing 23 and an annular bypass duct 24 is circumscribed about the core engine 13. An engine casing 21 circumscribes the bypass duct 24 which extends from the fan section 14 downstream past the low pressure turbine 22.

Engine air 25 enters the engine through an engine inlet 11 and is initially pressurized as it flows downstream through the fan section 14. A splitter 37 splits the engine air 25 into an inner portion thereof referred to as core engine air 3 which flows through the high pressure compressor 16 for further compression and an outer portion thereof referred to as bypass air 26 which bypasses the core engine 13 and flows through the bypass duct 24. The core engine air 3 is suitably mixed with fuel by fuel injectors 32 and carburetors in the main combustor 18 and ignited for generating hot combustion gases which flow through the turbines 20, 22 and are discharged therefrom as core gases 28 into a diffuser duct 33 aft and downstream of the turbines 20, 22 in the engine 10.

Figure 2:
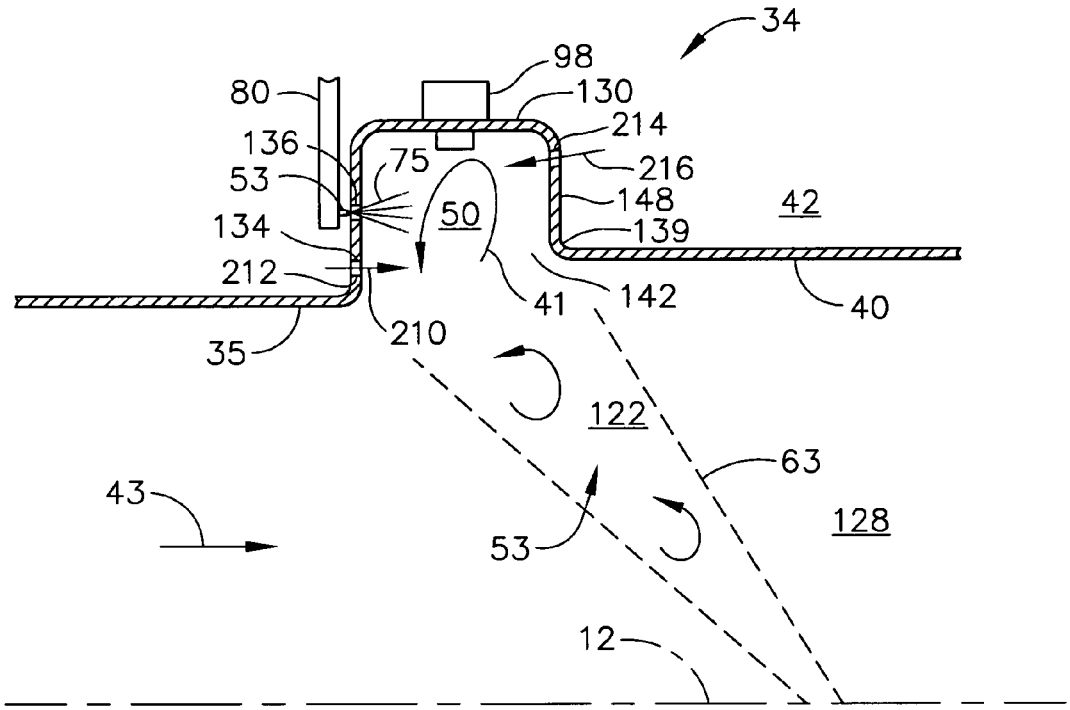
FIG. 2 is an enlarged sectional view of the trapped vortex cavity afterburner illustrated in FIG. 1.

Referring to FIGS. 1 and 2, the core engine 13 also includes an annular core outlet 30 and the bypass duct 24 includes an annular bypass duct outlet 27 for respectively discharging the core gases 28 and an injected portion 29 of the bypass air 26 downstream into the exhaust section 126 of the engine 10. The bypass duct outlet 27 is illustrated herein as being annular but may be of another shape and may be segmented. A mixer 31 is disposed in the annular bypass duct outlet 27 and includes a plurality of injector chutes 58 extending radially inwardly into the exhaust flowpath 128 from the bypass duct 24. The mixer 31 mixes the core gases 28 and the an injected portion 29 of the bypass air 26 resulting in an exhaust gas flow 43 and flows it into the exhaust section 126 and the combustion zone 44 within the exhaust section 126. Other means of mixing the core gases 28 and the injected portion 29 of the bypass air 26 and flowing it into the exhaust section 126 include well known aft variable area bypass injectors.

The exhaust section 126 includes an annular exhaust casing 36 disposed coaxially with and suitably attached to the corresponding engine casing 21 and surrounding an exhaust flowpath 128. Mounted to the aft end of the exhaust casing 36 is a conventional variable area converging-diverging exhaust nozzle 38 through which the bypass air 26 and core gases 28 are discharged during operation. The exhaust section 126 further includes an annular exhaust combustion liner 40 spaced radially inwardly from the exhaust casing 36 to define therebetween an annular cooling duct 42 disposed in flow communication with the bypass duct 24 for receiving therefrom a portion of the bypass air 26. The exhaust section 126 of the engine is by definition located aft of the turbines.

An exhaust section combustion zone 44 within the exhaust flowpath 128 is located radially inwardly from the exhaust liner 40 and the bypass duct 24 and downstream or aft of the core engine 13 and the low pressure turbine 22. An annular radially outer diffuser wall 46 is circumscribed around the diffuser duct 33 and is axially spaced apart from a forward end 35 of the combustion liner 40 inside the casing 36. Thus, the combustion zone 44 located radially inwardly from the bypass duct 24 and downstream and aft of the mixer 31 and bypass duct outlet 27. The diffuser wall 46 also defines an annular inner inlet 49 for passing the core gases 28 from the core outlet 30 into the combustion zone 44.

As illustrated in FIGS. 1 and 2, the engine 10 also includes an aftwardly converging centerbody 48 which extends aft and downstream from the core outlet 30, and partially into the exhaust section 126 of the engine 10. The diffuser duct 33 is radially inwardly bounded by the centerbody 48 and radially outwardly bounded by the diffuser wall 46 and serves to decrease the velocity of the core gases 28 as they enter the exhaust section 126.

Referring to FIGS. 1–5, the trapped vortex cavity afterburner 34 is disposed downstream of the low pressure turbine 22 and includes at least one annular trapped vortex cavity 50 for injecting a fuel/air mixture 53 into the engine downstream of the low pressure turbine 22 and into the combustion zone 44. The trapped vortex cavity afterburner 34 is disposed downstream of the low pressure turbine 22 and is the sole source of reheat for augmenting the thrust of the nozzle. The trapped vortex cavity afterburner 34 is operable to provide all reheat of the exhaust gas flow 43 and thrust augmentation and use all of the thrust augmenting fuel 75 used by the engine 10 for thrust augmentation or afterburning.

The fuel/air mixture is 53 ignited by an igniter 98 and the resulting flame is stabilized by the action of the annular trapped vortex cavity 50. The trapped vortex cavity 50 is utilized to produce an annular rotating vortex 41 of the fuel/air mixture more particularly illustrated in FIGS. 2–3. The trapped vortex cavity 50 is positioned with respect to the combustion zone 44 such that there is a aftwardly tapering frusto-conical path 63 from the cavity towards the centerline axis 12 in the combustion zone along which the combusting fuel/air mixture 53 is injected into the combustion zone 44. The air/fuel mixture 53 is in the shape of a conical vortex sheet generated from within the cavity and ignited by an igniter 98 positioned within or adjacent to the cavity 50.

Referring more particularly to FIG. 2, the trapped vortex cavity 50 includes a cavity forward wall 134, a cavity radially outer wall 130, and a cavity aft wall 148. A cavity opening 142 extends between the cavity forward and aft walls 134 and 148 at a radially inner end 139 of the trapped vortex cavity 50. The cavity opening 142 is open to combustion zone 44 and is spaced radially apart and inwardly of the cavity radially outer wall 130. Vortex driving aftwardly injected air 210 from the bypass air 26 is injected through air injection first holes 212 through the cavity forward wall 134 at a radial position along the forward wall near the opening 142 at the radially inner end 139 of the trapped vortex cavity 50. Vortex driving forwardly injected air 216 is injected through air injection second holes 214 in the cavity aft wall 148 positioned radially near the cavity radially outer wall 130.

The circumferentially disposed annular trapped vortex cavity 50, faces radially inwardly towards the centerline axis 12 in the combustion zone 44 so as to be in direct unobstructed fluid communication with the combustion zone 44. The annular trapped vortex cavity 50 is located aft and downstream of the mixer 31 at a radially outer portion 122 of the combustion zone 44 for maximizing flame ignition and stabilization in the combustion zone 44 during thrust augmentation or reheat. Fuel may be introduced into the trapped vortex cavity 50 at one or more locations. Illustrated in FIG. 2 is a first vortex fuel tube 80 extending radially inwardly through the radially outer wall 130 of the vortex cavity 50 and operable for injecting fuel into the vortex cavity 50. The first vortex fuel tubes 80 include a fuel hole for injecting the fuel 75 into the vortex cavity 50 through a fuel aperture 136 in the forward wall 134 of the trapped vortex cavity 50. Some of the bypass air 26 flows through the fuel apertures 136 helping to inject the fuel into the trapped vortex cavity 50. The trapped vortex cavity 50 in each of the trapped vortex cavity stages 52 illustrated herein is attached to or integrally formed with the exhaust combustion liner 40.

Figure 3:
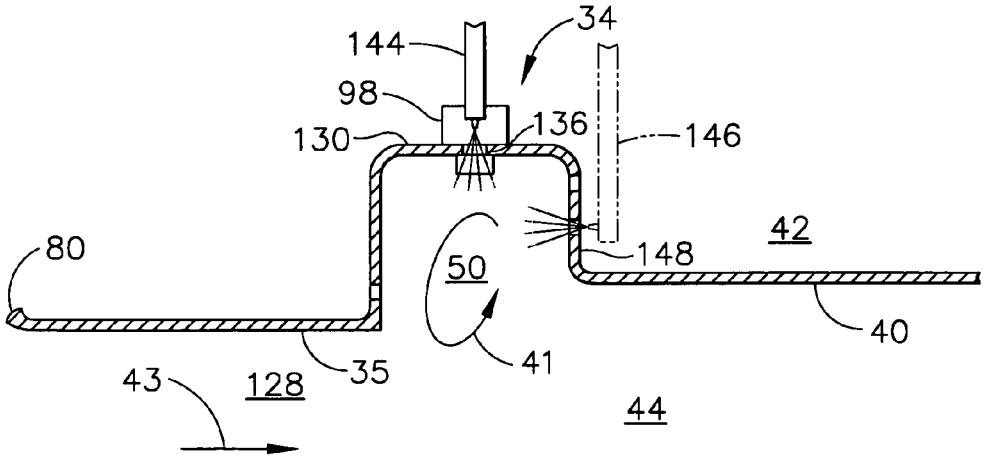
FIG. 3 is an enlarged sectional view of an alternative embodiment of a trapped vortex cavity in the trapped vortex cavity afterburner illustrated in FIG. 2.

Illustrated in FIG. 3 is another exemplary embodiment of the vortex cavity 50 having two different locations for injecting fuel into the trapped vortex cavity 50 are used. At the first location, a second vortex fuel tube 144 extends radially inwardly to a point just radially outside of the radially outer wall 130 of the vortex cavity 50. The second vortex fuel tube 144 is operable to inject fuel into the vortex cavity 50 through one or more fuel apertures 136 in the radially outer wall 130 of the vortex cavity 50. Some of the bypass air 26 flows through the fuel apertures 136 helping to inject the fuel into the trapped vortex cavity 50. An alternative third vortex fuel tube 146, illustrated in phantom line to indicate it circumferentially offset and out of plane with respect to the second vortex fuel tube 144, extends radially inwardly to a point just aft or downstream of a cavity aft wall 148 of the trapped vortex cavity 50. The third vortex fuel tube 146 is operable to inject fuel into the vortex cavity 50 through one or more fuel apertures 136 in the aft wall 148 of the trapped vortex cavity 50. Because of the higher pressure of the bypass air 26, some of the bypass air flows through the fuel apertures 136 helping to inject the fuel into the trapped vortex cavity 50.

Figure 4:
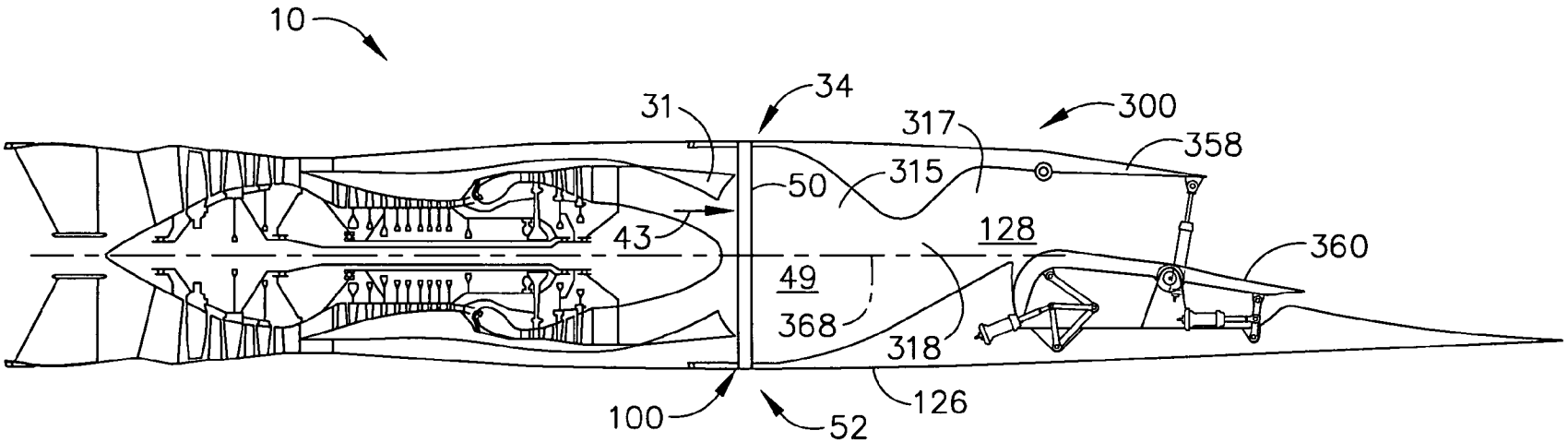
FIG. 4 is an axial sectional view through an exemplary turbofan gas turbine engine having a trapped vortex cavity afterburner and single expansion ramp nozzle.

Illustrated in FIGS. 3 and 4 is the igniter 98 disposed through the cavity radially outer wall 130 and operable to ignite the annular rotating vortex 41 of the fuel and air mixture and spread a flame front into the combustion zone 44. In some designs, two or more circumferentially spaced apart igniters 98 may be used. The trapped vortex cavity 50 thus serves as an afterburner or augmentor to provide additional thrust for the engine by increasing the temperature of the mixture of the core gases 28 and the bypass air 26 flowing from the bypass duct 24 and through the mixer 31 into the combustion zone 44. The igniter 98 may not always be needed. Suitable igniters include conventional electric spark igniters (spark plugs) and, more recent, radiative plasma ignition means such as those illustrated in U.S. Pat. Nos. 5,367,871, 5,640,841, 5,565,118, and 5,442,907. In some cases, the core gases 28 from the core outlet 30 flowing into the combustion zone 44 may be hot enough to ignite the fuel/air mixture of the vortex sheet.

Figure 5:
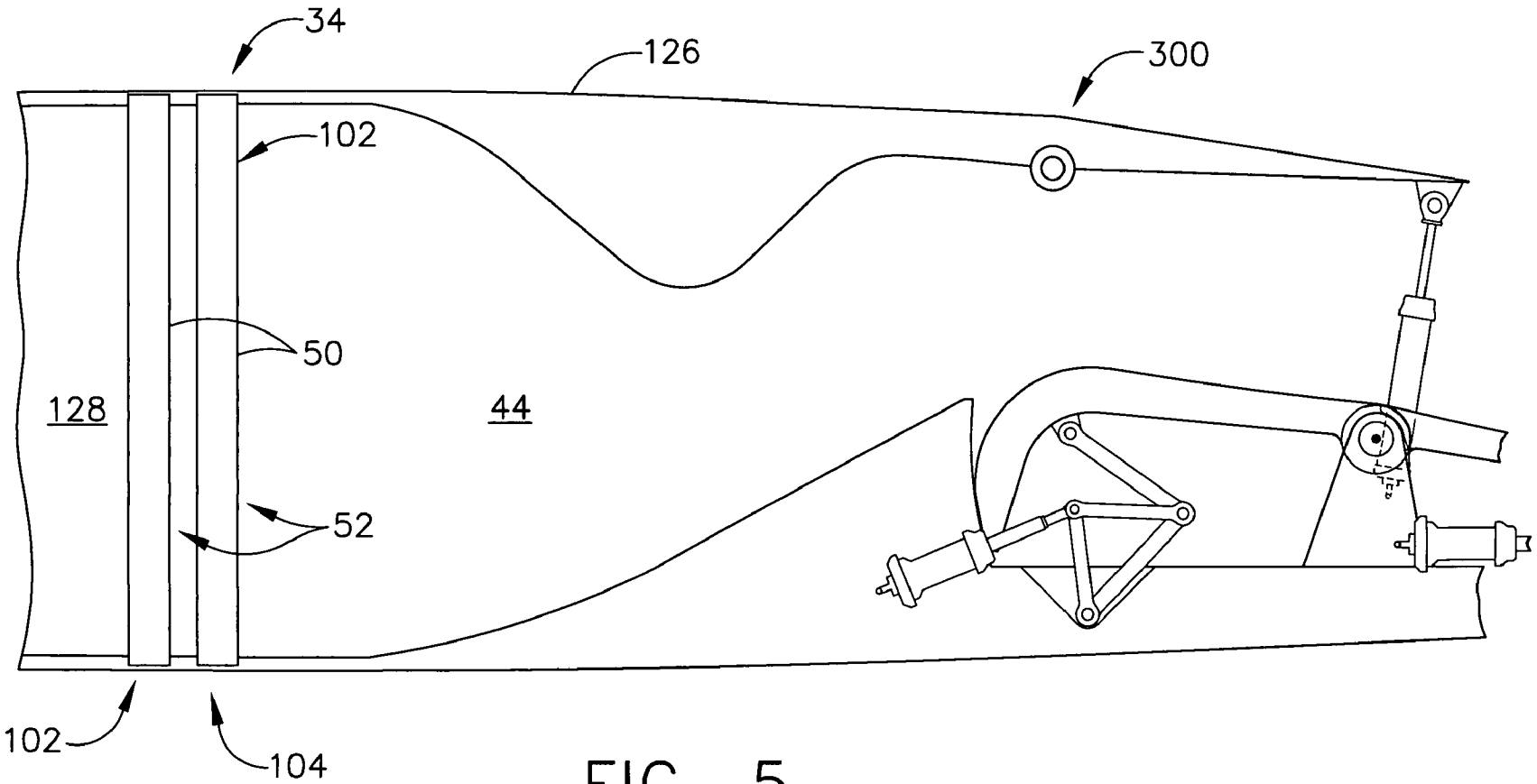
FIG. 5 is an enlarged axial sectional view of a multi stage trapped vortex cavity afterburner in an exhaust section of the engine illustrated in FIG. 4.

One particular application of the trapped vortex cavity afterburner 34 is in a single expansion ramp nozzle 300 (SERN) illustrated in FIGS. 4 and 5. SERN is a two-dimensional variable area nozzle providing installed performance characteristics of low weight and low frictional drag because there is no or a smaller lower cowl. SERN nozzles provide thrust pitch vectoring and Low Observable (LO) exhaust nozzle technology which is being developed for current and future fighter/attack aircraft. LO nozzles are easily integrated cleanly with the aircraft airframe and do not degrade the aircraft's performance due to weight and drag penalties. The SERN nozzle 300 illustrated herein is a convergent divergent two-dimensional gas turbine engine exhaust nozzle having convergent and divergent sections 315 and 317 and a variable area throat 318 therebetween. The divergent section 317 includes transversely spaced apart upper and lower divergent flaps 358 and 360, respectively, extending longitudinally downstream along a nozzle axis 368, illustrated as co-linear with the centerline axis 12, and disposed between two widthwise spaced apart first and second sidewalls not illustrated herein.

The trapped vortex cavity afterburner 34 illustrated in FIG. 4 is a single stage trapped vortex cavity afterburner 100 while the trapped vortex cavity afterburner 34 illustrated in FIG. 5 is a double stage trapped vortex cavity afterburner 102 representative of a multi-stage afterburner 104 which have two or more trapped vortex cavity stages 52. Each of the trapped vortex cavity stages 52 have the trapped vortex cavity 50. Each stage or trapped vortex cavity 50 is used to incrementally add heat to and raise the temperature of the mixture of the exhaust gas flow 43 flowing through the combustion zone 44. The amount of heat added by the trapped vortex cavity afterburner 34 to the exhaust gas flow 43 in the exhaust section 126 is not as much as compared to conventional augmentors using fuel injectors or fuel bars and radial and/or circumferential flameholders.

An exemplary embodiment of the trapped vortex cavity afterburner 34 is designed to raise the temperature of the exhaust gas flow 43 in the exhaust section 126 by about 100 degrees Fahrenheit for each stage of the trapped vortex cavity 50 incorporated in the trapped vortex cavity afterburner 34. The stages of the trapped vortex cavity 50 in the multi-stage afterburners 104 can be initiated simultaneously or individually. Each of the trapped vortex cavity stages 52 may be operable to produce the same amount of additional thrust or temperature rise in the exhaust gas flow 43 flowing through the afterburner or different amounts. One embodiment of the trapped vortex cavity afterburner 34 may have five stages of trapped vortex cavities 50 wherein each stage is operable to produce a temperature rise of 150 degrees F. in the exhaust gas flow 43 through the afterburner. The stages of trapped vortex cavities 50 may be ganged and ignited simultaneously or sequentially one or more at a time such that varying amounts of reheat are produced. Another embodiment of the trapped vortex cavity afterburner 34 may have three stages of trapped vortex cavities 50 wherein each stage is operable to produce a different temperature rise, for example 150, 250, and 350 degrees F. in the exhaust gas flow 43. The stages of trapped vortex cavities 50 may be ganged and ignited simultaneously or sequentially one or more at a time such that varying amounts of reheat are produced.

Figure 6:
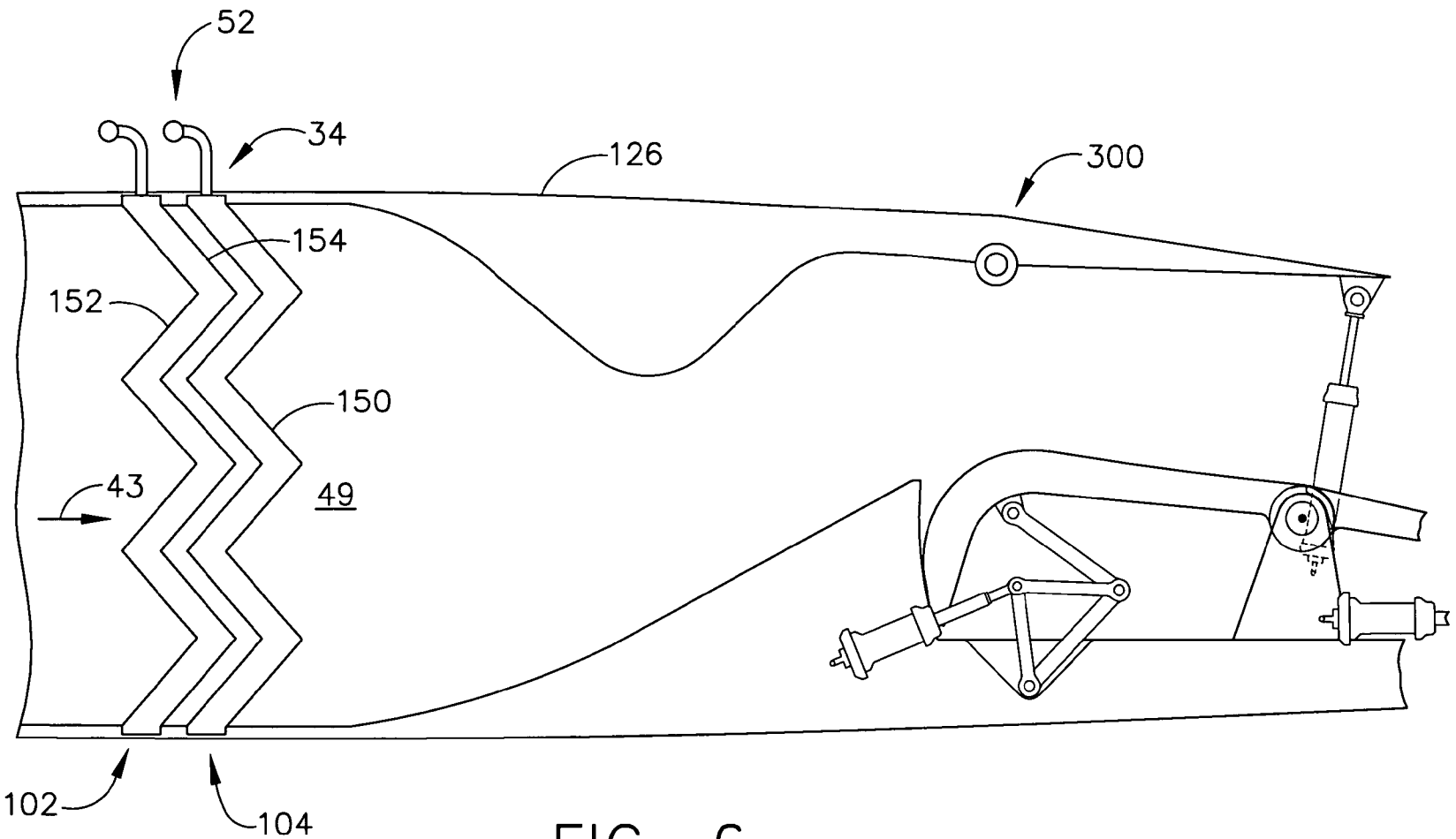
FIG. 6 is a sectional view of an the alternative embodiment of the multi stage trapped vortex cavity afterburner illustrated in FIG. 5 with chevron shaped trapped vortex cavities.

The trapped vortex cavity afterburner 34 illustrated in FIG. 6 is the double stage trapped vortex cavity afterburner 102 representing multi-stage afterburners 104 which have two or more trapped vortex cavity stages 52. Each of the trapped vortex cavity stages 52 has a chevroned shaped trapped vortex cavity 150. Each of the chevron shaped trapped vortex cavities 150 has zig-zag shaped leading and trailing edges 152 and 154. The chevron shaped trapped vortex cavity 150 may be used in single stage trapped vortex cavity afterburners 100 or multi-stage afterburners 104 to help reduce the radar signature of the trapped vortex cavity afterburner 34.

Though the trapped vortex cavity afterburner 34 is illustrated in the exhaust section 126 of an exemplary medium bypass ratio turbofan gas turbine engine 10, it may be used in various other types of gas turbine engines such as a turbojet. When the trapped vortex cavity afterburner is used in a turbojet, exhaust flow from the turbines contain oxygen to be used for combustion by the afterburner. Compressor air may be flowed to the afterburner of the turbojet in order to have more oxygen for combustion.

The trapped vortex cavity afterburner 34 provides a thrust augmentation system that is inexpensive to manufacture and produce, and has the performance to meet the requirements of low levels of thrust augmentation or reheat. In an exemplary embodiment of the engine, each stage of the augmentor would produce approximately 150 degrees F. of temperature rise. The trapped vortex cavity afterburner 34 is probably capable of providing a heat or temperature rise or temperature rise of about of 100 to 200 degrees Fahrenheit for each stage containing a single annular trapped vortex cavity 50. The trapped vortex cavity afterburner 34 has no need for instream flameholders and development cost, acquisition cost, and maintenance costs would be low. The trapped vortex cavity afterburner 34 provides improved dry performance because there are no flameholders to reduce nozzle performance. The trapped vortex cavity afterburner 34 decreases the weight of the engine compared to one with conventional afterburners.

The trapped vortex cavity afterburner 34 may be used for various flight conditions calling for an additional amount of thrust for a short period of time. Takeoff and flight maneuvers are two examples of these flight conditions. The trapped vortex cavity afterburner 34 can be used to get overcome transonic drag rise as the engine propels an aircraft through transonic flight to supersonic flight where drag decreases and dry operation of the engine may be resumed.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims:

What is claimed is:

1. A trapped vortex cavity afterburner comprising:

one or more trapped vortex cavity stages for injecting a fuel/air mixture into a combustion zone, the one or more trapped vortex cavity stages operable to provide all thrust augmenting fuel used for engine thrust augmentation, and each one of the one or more trapped vortex cavity stages having at least one annular trapped vortex cavity.

2. A trapped vortex cavity afterburner as claimed in claim 1 further comprising:

the trapped vortex cavity including a cavity forward wall, a cavity radially outer wall, and a cavity aft wall, a cavity opening extending between the cavity forward and aft walls at a radially inner end of the trapped vortex cavity, radially spaced apart pluralities of air injection first and second holes through the cavity forward and aft walls respectively, and first vortex fuel tubes positioned relative to the vortex cavity and operable for injecting fuel into the vortex cavity.

3. A trapped vortex cavity afterburner as claimed in claim 2 further comprising at least one igniter positioned within or adjacent to the cavity.

4. A trapped vortex cavity afterburner as claimed in claim 1 further comprising the trapped vortex cavity afterburner being a multi-stage afterburner having two or more trapped vortex cavity stages wherein the trapped vortex cavity stages are ganged for simultaneous ignition or operable for sequential ignition.

5. A trapped vortex cavity afterburner as claimed in claim 4 further comprising each of the trapped vortex cavity stages is operable to produce a single or a different amount of temperature rise in an exhaust gas flow flowing through the afterburner.

6. A trapped vortex cavity afterburner as claimed in claim 4 further comprising the annular trapped vortex cavity in each of the trapped vortex cavity stages being a chevron shaped trapped vortex cavity and having zig-zag shaped leading and trailing edges.

7. A trapped vortex cavity afterburner as claimed in claim 1 further comprising the annular trapped vortex cavity being operable to raise a temperature of an exhaust gas flow about 100 to 200 degrees Fahrenheit.

8. A gas turbine engine exhaust section comprising:

an annular exhaust combustion liner surrounding at least a portion of a combustion zone, a trapped vortex cavity afterburner having one or more trapped vortex cavity stages for injecting a fuel/air mixture into the combustion zone, the one or more trapped vortex cavity stages operable to provide all thrust augmenting fuel used for engine thrust augmentation, and each one of the one or more trapped vortex cavity stages having at least one annular trapped vortex cavity.

9. A gas turbine engine exhaust section as claimed in claim 8 further comprising the trapped vortex cavity in each one of the one or more trapped vortex cavity stages being attached to or integrally formed with the exhaust combustion liner.

10. A gas turbine engine exhaust section as claimed in claim 9 further comprising:

the trapped vortex cavity including a cavity forward wall, a cavity radially outer wall, and a cavity aft wall, a cavity opening extending between the cavity forward and aft walls at a radially inner end of the trapped vortex cavity, radially spaced apart pluralities of air injection first and second holes through the cavity forward and aft walls respectively, and first vortex fuel tubes positioned relative to the vortex cavity and operable for injecting fuel into the vortex cavity.

11. A gas turbine engine exhaust section as claimed in claim 10 further comprising at least one igniter positioned within or adjacent to the cavity.

12. A gas turbine engine comprising:

a fan section upstream of a core engine, an exhaust combustion zone downstream of the core engine, a gas turbine engine exhaust section located downstream of a turbine section and including an annular exhaust combustion liner surrounding at least a portion of a combustion zone, a trapped vortex cavity afterburner having one or more trapped vortex cavity stages for injecting a fuel/air mixture into the combustion zone, each one of the one or more trapped vortex cavity stages having at least one annular trapped vortex cavity located aft and downstream of the core engine at a radially outer portion of the combustion zone, and the one or more trapped vortex cavity stages operable to provide all thrust augmenting fuel used for engine thrust augmentation.

13. A gas turbine engine as claimed in claim 12 further comprising an annular bypass duct circumscribing the core engine means of mixing core gases from the core engine and an injected portion of bypass air in the bypass duct and flowing a resulting mixture of gases from the core engine and the injected portion into the combustion zone.

14. A gas turbine engine as claimed in claim 13 further comprising the trapped vortex cavity in each one of the one or more trapped vortex cavity stages being attached to or integrally formed with the exhaust combustion liner.

15. A gas turbine engine as claimed in claim 14 further comprising:

the trapped vortex cavity including a cavity forward wall, a cavity radially outer wall, and a cavity aft wall, a cavity opening extending between the cavity forward and aft walls at a radially inner end of the trapped vortex cavity, radially spaced apart pluralities of air injection first and second holes through the cavity forward and aft walls respectively, and first vortex fuel tubes positioned relative to the vortex cavity and operable for injecting fuel into the vortex cavity.

16. A gas turbine engine as claimed in claim 15 further comprising at least one igniter positioned within or adjacent to the cavity.

17. A turbofan gas turbine engine comprising:

a fan section upstream of a core engine, an exhaust combustion zone downstream of the core engine, a trapped vortex cavity afterburner having one or more trapped vortex cavity stages for injecting a fuel/air mixture into the combustion zone, each one of the one or more trapped vortex cavity stages having at least one annular trapped vortex cavity located aft and downstream of the core engine at a radially outer portion of the combustion zone, and the one or more trapped vortex cavity stages operable to provide all thrust augmenting fuel used for engine thrust augmentation.

18. A turbofan gas turbine engine as claimed in claim 17 further comprising an annular bypass duct circumscribing the core engine means of mixing core gases from the core engine and an injected portion of bypass air in the bypass duct and flowing a resulting mixture of gases from the core engine and the injected portion into the combustion zone.

19. A turbofan gas turbine engine as claimed in claim 18 further comprising the trapped vortex cavity in each one of the one or more trapped vortex cavity stages being attached to or integrally formed with the exhaust combustion liner.

20. A turbofan gas turbine engine as claimed in claim 19 further comprising:

the trapped vortex cavity including a cavity forward wall, a cavity radially outer wall, and a cavity aft wall, a cavity opening extending between the cavity forward and aft walls at a radially inner end of the trapped vortex cavity, radially spaced apart pluralities of air injection first and second holes through the cavity forward and aft walls respectively, and first vortex fuel tubes positioned relative to the vortex cavity and operable for injecting fuel into the vortex cavity.

21. A turbofan gas turbine engine as claimed in claim 20 further comprising at least one igniter positioned within or adjacent to the cavity.

22. A method for gas turbine engine thrust augmentation comprising injecting all thrust augmenting fuel used for engine thrust augmentation through a trapped vortex cavity afterburner having one or more trapped vortex cavity stages wherein each one of the one or more trapped vortex cavity stages includes at least one annular trapped vortex cavity.

23. A method as claimed in claim 22 further comprising operating the annular trapped vortex cavity to raise a temperature of an exhaust gas flow in a range of about 100 to 200 degrees Fahrenheit.

24. A method as claimed in claim 22 wherein the trapped vortex cavity afterburner is a multi-stage afterburner having two or more trapped vortex cavity stages and the method further includes the trapped vortex cavity stages being ganged and simultaneously fed fuel, ignited, and operated or not being ganged and fed fuel, ignited, and operated sequentially.

25. A method as claimed in claim 24 further comprising operating the trapped vortex cavity in each of the trapped vortex cavity stages to raise a temperature of an exhaust gas flow about 100 to 200 degrees Fahrenheit.

26. A method as claimed in claim 25 further comprising operating the trapped vortex cavity in at least two of the trapped vortex cavity stages to raise the temperature of the exhaust gas flow different amounts.

* * * * *